US009765566B1

(12) United States Patent
Chen

(10) Patent No.: US 9,765,566 B1
(45) Date of Patent: Sep. 19, 2017

(54) CORDLESS MOTORIZED ROLLER SHADE

(71) Applicant: CALENDAR ENTERPRISES CO., LTD., Chang-Hwa, Hsien (TW)

(72) Inventor: Ju-Huai Chen, Chang-Hwa Hsien (TW)

(73) Assignee: Calendar Enterprises Co., Ltd., Chang-Hwa Hsien (TW)

( * ) Notice: Subject to any disclaimer, the term of this patent is extended or adjusted under 35 U.S.C. 154(b) by 0 days.

(21) Appl. No.: 15/159,868

(22) Filed: May 20, 2016

(51) Int. Cl.

| | |
|---|---|
| ***A47H 5/00*** | (2006.01) |
| ***E06B 9/42*** | (2006.01) |
| ***E06B 9/44*** | (2006.01) |
| ***E06B 9/58*** | (2006.01) |
| ***E06B 9/72*** | (2006.01) |
| ***A47H 23/01*** | (2006.01) |
| *E06B 9/24* | (2006.01) |
| *E06B 9/68* | (2006.01) |

(52) U.S. Cl.
CPC ..... *E06B 9/42* (2013.01); *A47H 23/01* (2013.01); *E06B 9/44* (2013.01); *E06B 9/58* (2013.01); *E06B 9/72* (2013.01); *A47H 2201/02* (2013.01); *E06B 2009/2447* (2013.01); *E06B 2009/587* (2013.01); *E06B 2009/6809* (2013.01)

(58) Field of Classification Search
CPC ..... E06B 9/42; E06B 9/44; E06B 9/58; E06B 9/72; E06B 2009/2447; E06B 2009/2622; A47H 23/01; A47H 2201/02
See application file for complete search history.

(56) References Cited

U.S. PATENT DOCUMENTS

| | | | | |
|---|---|---|---|---|
| 4,417,185 | A * | 11/1983 | Bullat | E06B 9/74 160/1 |
| 5,848,634 | A * | 12/1998 | Will | E06B 9/174 160/1 |
| 6,497,267 | B1 * | 12/2002 | Azar | E06B 9/42 160/188 |
| 6,860,310 | B2 * | 3/2005 | Kubly | E06B 9/13 160/122 |
| 8,186,411 | B2 * | 5/2012 | Lin | E06B 9/262 160/108 |
| 8,251,120 | B2 * | 8/2012 | Chen | E06B 9/42 160/314 |
| 8,267,144 | B2 * | 9/2012 | Hsu | E06B 9/262 160/264 |

(Continued)

*Primary Examiner* — Katherine Mitchell
*Assistant Examiner* — Abe Massad
(74) *Attorney, Agent, or Firm* — Alan D. Kamrath; Kamrath IP Lawfirm, P.A.

(57) ABSTRACT

A cordless motorized roller shade includes a motorized operation device, a shading device mounted on the motorized operation device and hanging down, and a combination module detachably mounted between the motorized operation device and the shading device. Thus, the roll cloth member of the motorized operation device is pressed by the holding units of the shading device so that the roll cloth member is kept at a straight state smoothly when hanging down. In addition, when the roll cloth member is moved upward, the rotary return wheel module of the motorized operation device aids the upward movement of the roll cloth member to reduce consumption of the electric power of the drive motor of the motorized operation device during operation so that the roll cloth member is folded upward in an energy-saving manner.

5 Claims, 9 Drawing Sheets

(56) References Cited

U.S. PATENT DOCUMENTS

| | | | | |
|---|---|---|---|---|
| 2007/0056697 | A1* | 3/2007 | Chen | E06B 9/70 160/310 |
| 2009/0199975 | A1* | 8/2009 | Yeh | E06B 9/262 160/84.02 |
| 2010/0294438 | A1* | 11/2010 | Kirby | E06B 9/262 160/84.04 |
| 2011/0247762 | A1* | 10/2011 | Lin | E06B 9/262 160/84.02 |
| 2013/0312920 | A1* | 11/2013 | Mullet | E06B 9/40 160/310 |
| 2015/0034259 | A1* | 2/2015 | Bohlen | E06B 9/42 160/310 |

* cited by examiner

CORDLESS MOTORIZED ROLLER SHADE

BACKGROUND OF THE INVENTION

1. Field of the Invention

The present invention relates to a window accessory and, more particularly, to a cordless motorized roller shade mounted on a window or door.

2. Description of the Related Art

A conventional motorized roller shade in accordance with the prior art shown in FIG. 9 comprises a winding mechanism 4 having a shaft 41 and a shade cloth 5 having an upper end secured to the shaft 41 of the winding mechanism 4. When the winding mechanism 4 is operated, the shaft 41 of the winding mechanism 4 is rotated to move the shade cloth 5 upward or downward so as to fold or expand the shade cloth 5. Thus, the shade cloth 5 is expanded and folded by operation of the winding mechanism 4 without needing a pull cord so that the conventional motorized roller shade is operated safely and conveniently. However, when the shade cloth 5 hangs down, there is no support force to limit the two sides of the shade cloth 5 so that the two sides of the shade cloth 5 are easily flexed. Thus, the shade cloth 5 is not expanded in a straight manner when hanging down, thereby decreasing the appearance of the conventional motorized roller shade.

BRIEF SUMMARY OF THE INVENTION

The primary objective of the present invention is to provide a cordless motorized roller shade that is kept at a straight state smoothly when hanging down.

Another objective of the present invention is to provide a cordless motorized roller shade with an energy-saving function.

In accordance with the present invention, there is provided a cordless motorized roller shade comprising a motorized operation device, a shading device and a combination module. The motorized operation device includes a winding unit, a transmission unit, a frame unit, a signal receiver and a controller. The winding unit includes a drive shaft, a roll cloth member having an upper end affixed to the drive shaft and a lower end provided with a first tubular portion, and a first weight bar mounted in the first tubular portion of the roll cloth member. The drive shaft of the winding unit has a first end provided with a cavity and a second end provided with a pivot portion. The transmission unit is mounted in the cavity of the drive shaft of the winding unit to drive and rotate the drive shaft of the winding unit so as to wind or unwind the roll cloth member of the winding unit. The frame unit supports the winding unit and the transmission unit. The frame unit includes a fixed track, a first side bracket mounted on a first end of the fixed track for mounting the transmission unit, a second side bracket mounted on a second end of the fixed track for mounting the pivot portion of the drive shaft of the winding unit, and a rotary return wheel module mounted in the second side bracket and pivotally connected with the pivot portion of the drive shaft of the winding unit. The signal receiver is coupled to and electrically connected with the transmission unit. The controller matches the signal receiver and transmits a signal to the signal receiver to control operation of the transmission unit. The shading device includes a shade cloth member having an upper end secured to the fixed track of the frame unit of the motorized operation device and a lower end provided with a second tubular portion, a second weight bar mounted in the second tubular portion of the shade cloth member, and a plurality of holding units mounted on the shade cloth member. The shade cloth member of the shading device has a front face provided with a plurality of mounting sleeves. Each of the holding units of the shading device includes a rod mounted in each of the mounting sleeves of the shade cloth member, two holding pieces mounted on two ends of the rod, and two fasteners respectively mounted on the two holding pieces and pressing the rod so that the two holding pieces are affixed to the rod. The combination module is mounted between the motorized operation device and the shading device and includes a first connecting member mounted on the fixed track of the frame unit of the motorized operation device and a second connecting member mounted on the shade cloth member of the shading device. The second connecting member is removably connected with the first connecting member so that the shading device and the motorized operation device are connected detachably.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
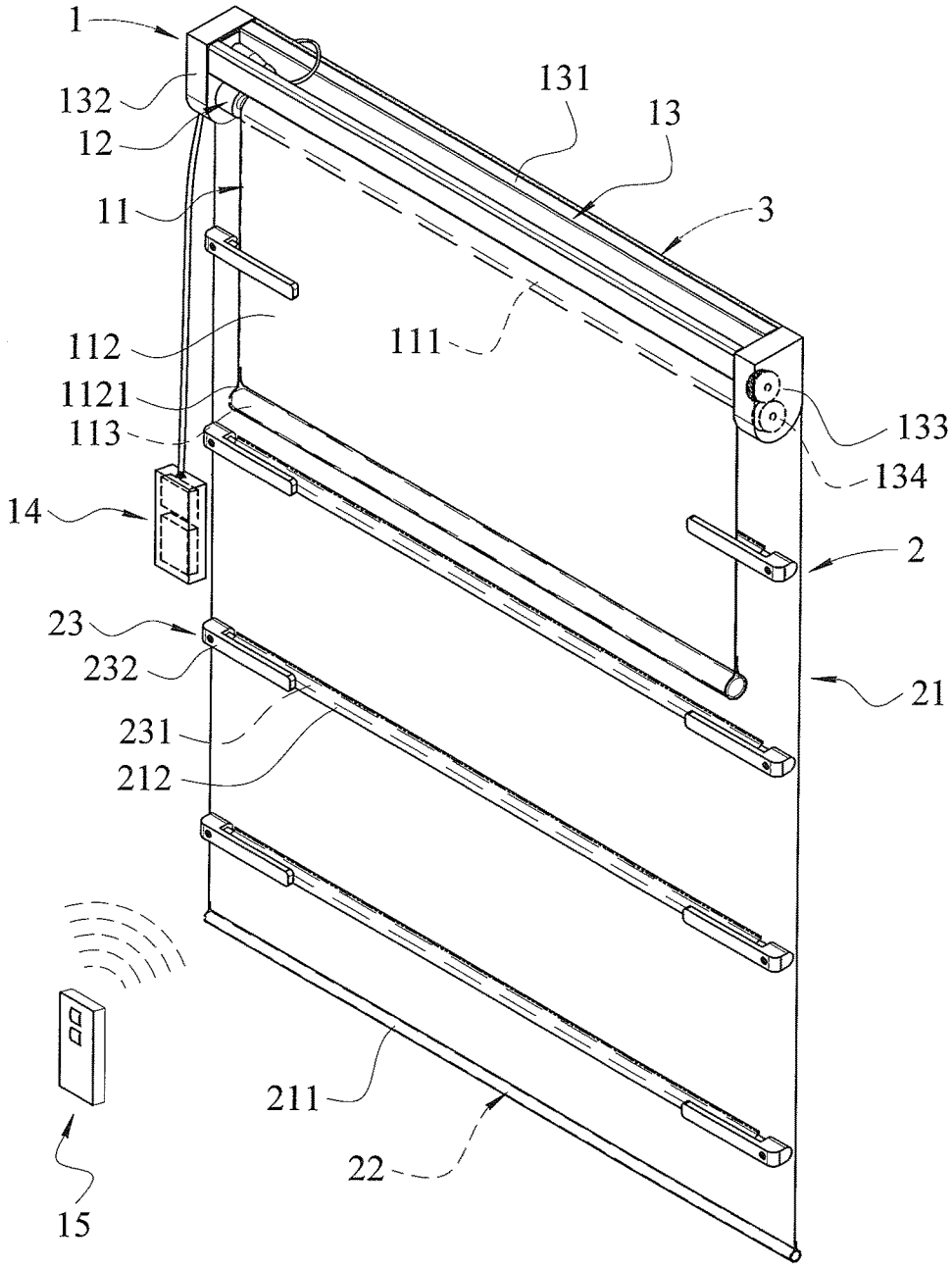
FIG. 1 is a perspective view of a cordless motorized roller shade in accordance with the preferred embodiment of the present invention.
Figure 2:
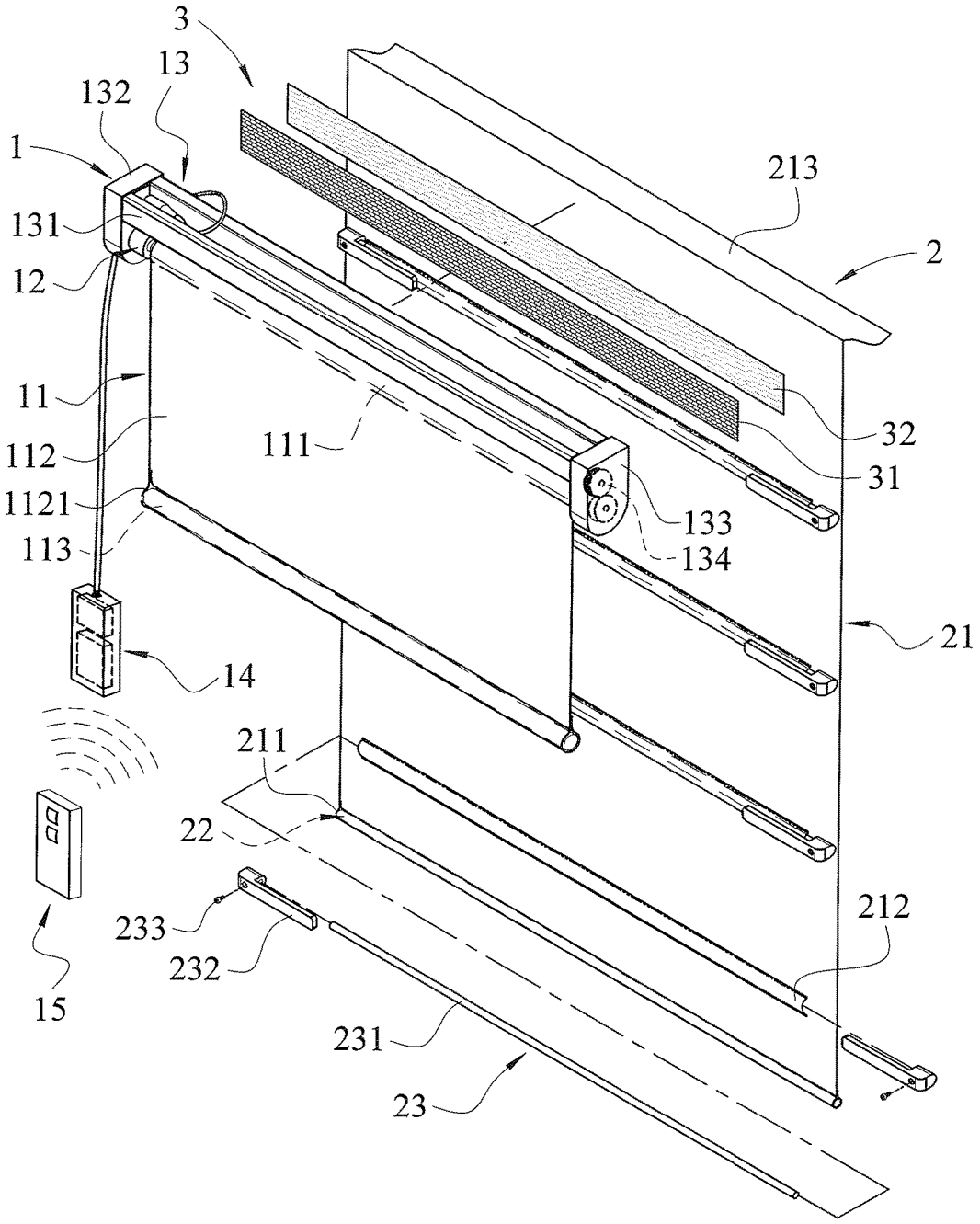
FIG. 2 is an exploded perspective view of the cordless motorized roller shade as shown in FIG. 1.
Figure 3:
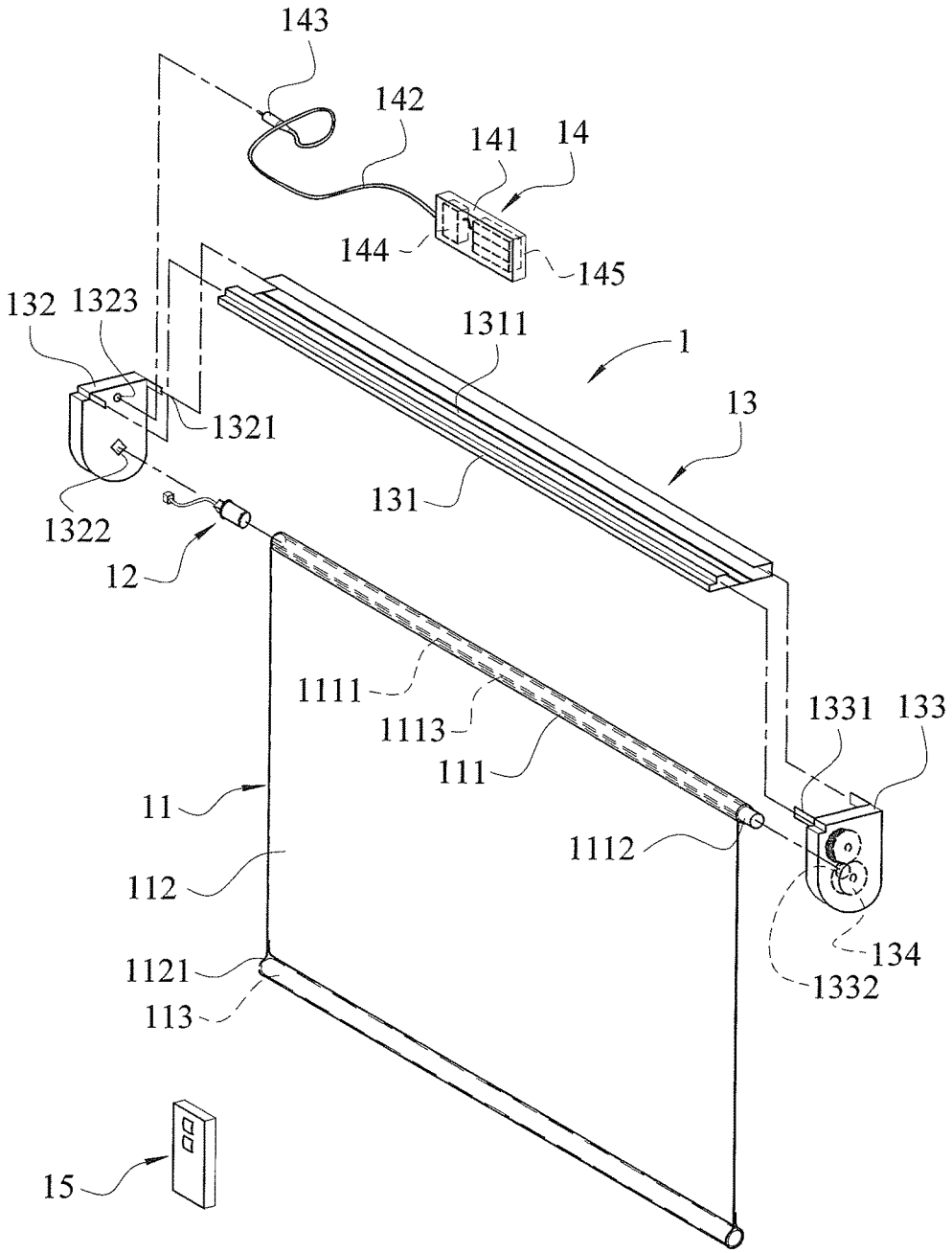
FIG. 3 is a partially exploded perspective view of the cordless motorized roller shade as shown in FIG. 1.
Figure 4:
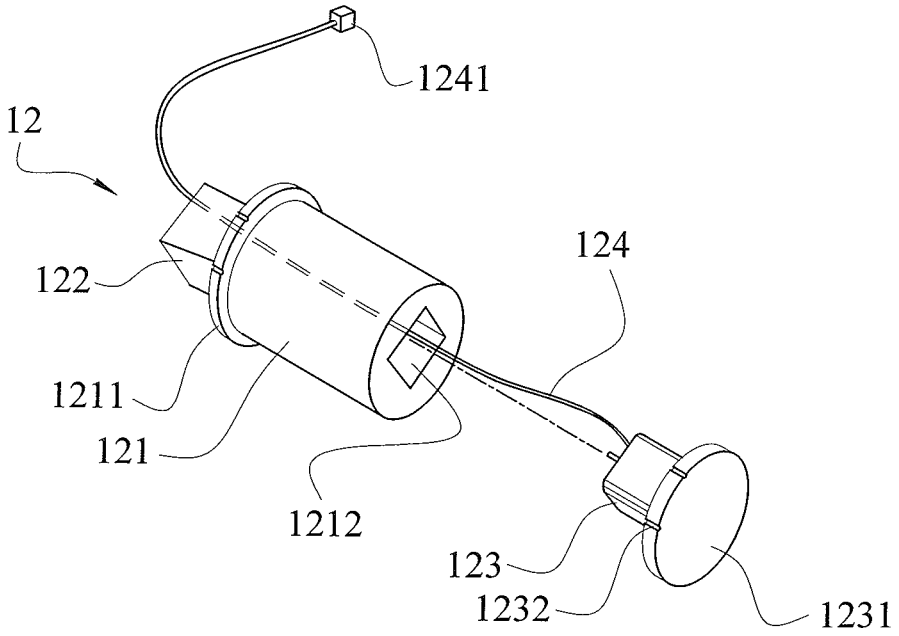
FIG. 4 is an exploded perspective view of a transmission unit of the cordless motorized roller shade in accordance with the preferred embodiment of the present invention.
Figure 5:
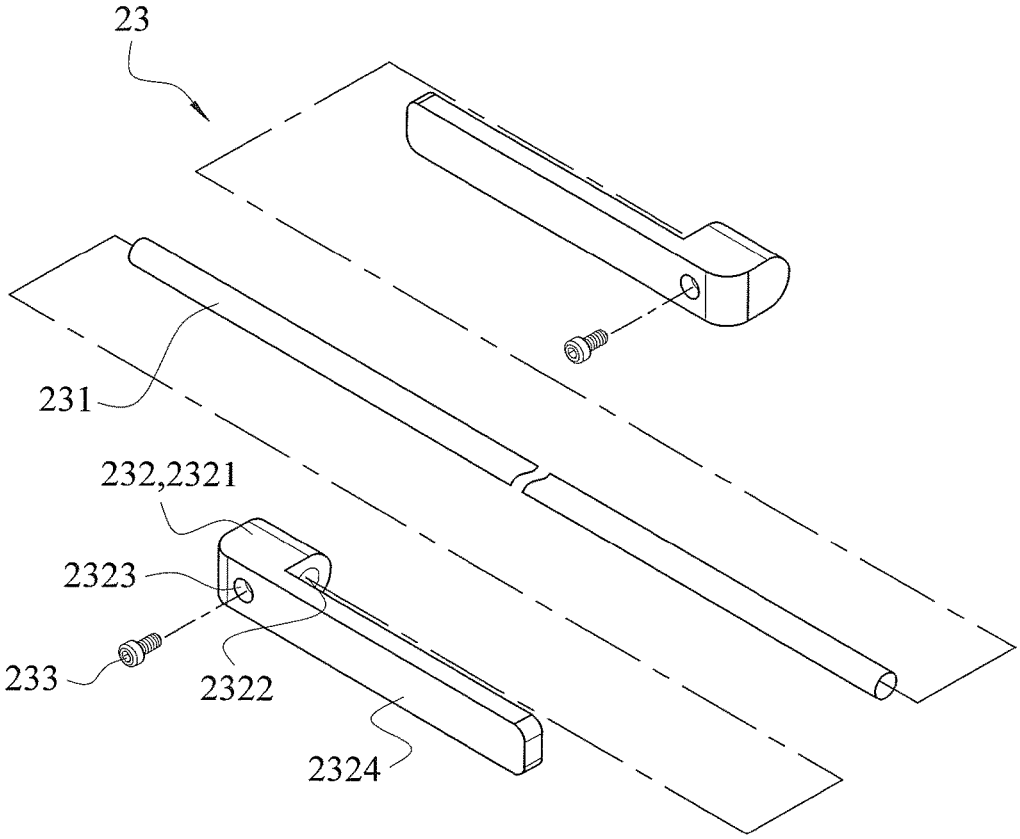
FIG. 5 is an exploded perspective view of a holding unit of the cordless motorized roller shade in accordance with the preferred embodiment of the present invention.

Referring to the drawings and initially to FIGS. 1-5, a cordless motorized roller shade in accordance with the preferred embodiment of the present invention comprises a motorized operation device 1, a shading device 2 and a combination module 3.

The motorized operation device 1 includes a winding unit 11, a transmission unit 12, a frame unit 13, a signal receiver 14 and a controller 15.

The winding unit 11 includes a drive shaft 111, a roll cloth member 112 having an upper end affixed to the drive shaft 111 and a lower end provided with a first tubular portion 1121 by sewing, and a first weight bar 113 mounted in the first tubular portion 1121 of the roll cloth member 112. The drive shaft 111 of the winding unit 11 has a first end provided with a cavity 1111 and a second end provided with a pivot portion 1112. The lower end of the roll cloth member 112 is encircled and sewn to form the first tubular portion 1121.

The transmission unit 12 is mounted in the cavity 1111 of the drive shaft 111 of the winding unit 11 to drive and rotate the drive shaft 111 of the winding unit 11 so as to wind or unwind the roll cloth member 112 of the winding unit 11 so that the roll cloth member 112 of the winding unit 11 is folded upward or hangs downward.

The frame unit 13 supports the winding unit 11 and the transmission unit 12. The frame unit 13 is preferably made of metallic material, such as copper, stainless steel, aluminum, zinc or iron. The frame unit 13 includes a fixed track 131 having an elongate shape, a first side bracket 132 mounted on a first end of the fixed track 131 for mounting the transmission unit 12, a second side bracket 133 mounted on a second end of the fixed track 131 for mounting the pivot portion 1112 of the drive shaft 111 of the winding unit 11, and a rotary return wheel module 134 mounted in the second side bracket 133 and pivotally connected with the pivot portion 1112 of the drive shaft 111 of the winding unit 11. The rotary return wheel module 134 aids movement of the roll cloth member 112 of the winding unit 11 when the roll cloth member 112 of the winding unit 11 is folded upward to reduce an electric consumption of the transmission unit 12 during operation so that the roll cloth member 112 of the winding unit 11 is folded upward in an energy-saving manner.

The signal receiver 14 is coupled to and electrically connected with the transmission unit 12.

The controller 15 matches the signal receiver 14 and transmits a signal to the signal receiver 14 to control operation of the transmission unit 12.

The shading device 2 includes a shade cloth member 21 having an upper end secured to the fixed track 131 of the frame unit 13 of the motorized operation device 1 and a lower end provided with a second tubular portion 211 by sewing, a second weight bar 22 mounted in the second tubular portion 211 of the shade cloth member 21, and a plurality of holding units 23 mounted on the shade cloth member 21.

The shade cloth member 21 of the shading device 2 hangs down freely and has an upper end provided with an extension 213. The lower end of the shade cloth member 21 is encircled and sewn to form the second tubular portion 211. The shade cloth member 21 of the shading device 2 has a front face provided with a plurality of mounting sleeves 212. Preferably, each of the mounting sleeves 212 is made of cloth material and is sewn on the front face of the shade cloth member 21.

The holding units 23 of the shading device 2 hold the roll cloth member 112 of the winding unit 11 of the motorized operation device 1 when the roll cloth member 112 hangs down so that the roll cloth member 112 is kept at a straight state when hanging down. Each of the holding units 23 of the shading device 2 includes an elongate rod 231 mounted in each of the mounting sleeves 212 of the shade cloth member 21, two holding pieces 232 mounted on two ends of the rod 231, and two fasteners 233 respectively mounted on the two holding pieces 232 and pressing the rod 231 so that the two holding pieces 232 are affixed to the rod 231.

The combination module 3 is mounted between the motorized operation device 1 and the shading device 2 and includes a first connecting member 31 mounted on the fixed track 131 of the frame unit 13 of the motorized operation device 1 by bonding and a second connecting member 32 mounted on the shade cloth member 21 of the shading device 2 by sewing. Preferably, the combination module 3 is a Velcro closure, and the second connecting member 32 is removably connected with the first connecting member 31 so that the shading device 2 and the motorized operation device 1 are connected detachably.

In the preferred embodiment of the present invention, the fixed track 131 of the frame unit 13 of the motorized operation device 1 is provided with a receiving channel 1311 for mounting the first side bracket 132 and the second side bracket 133.

In the preferred embodiment of the present invention, the first side bracket 132 is provided with at least one locking end 1321 inserted into the receiving channel 1311 of the fixed track 131 so that the first side bracket 132 is detachably mounted on the fixed track 131. The first side bracket 132 is further provided with a receiving hole 1322 and a connecting hole 1323. The transmission unit 12 is received in the receiving hole 1322 of the first side bracket 132. The second side bracket 133 is provided with at least one locking end 1331 inserted into the receiving channel 1311 of the fixed track 131 so that the second side bracket 133 is detachably mounted on the fixed track 131. The second side bracket 133 is provided with a receiving aperture 1332, and the pivot portion 1112 of the drive shaft 111 of the winding unit 11 is received in the receiving aperture 1332 of the second side bracket 133.

Figure 7:
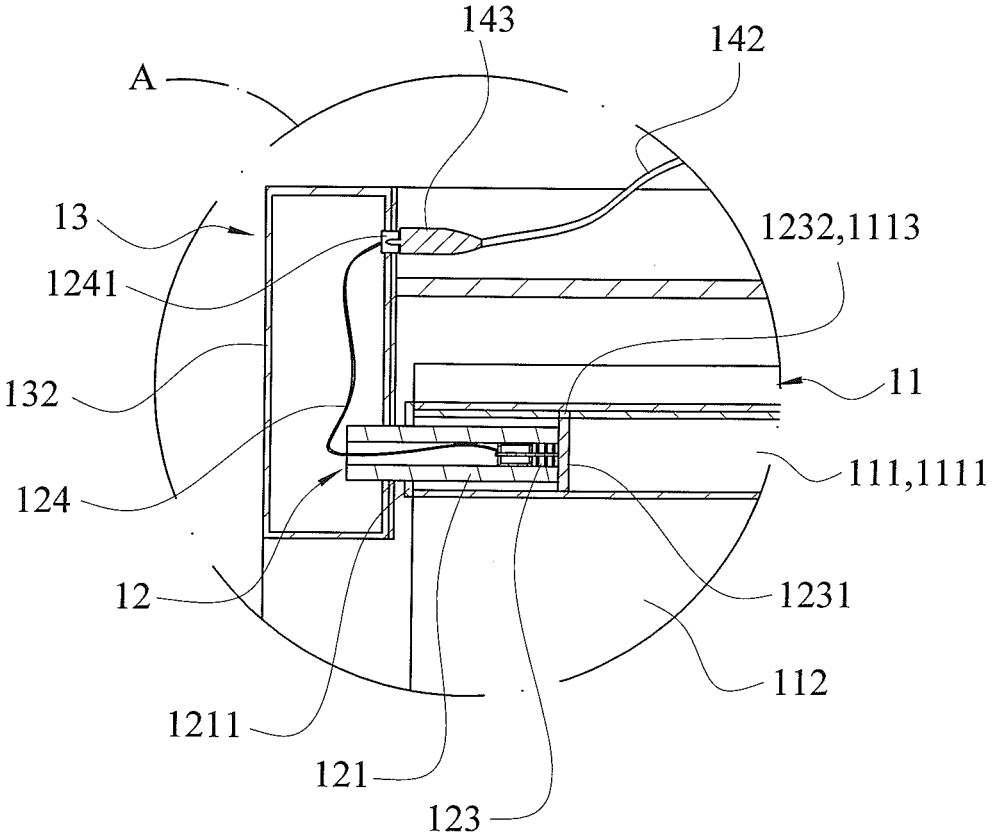
FIG. 7 is a locally enlarged view of the cordless motorized roller shade taken along mark "A" as shown in FIG. 6.

In the preferred embodiment of the present invention, the transmission unit 12 includes a driving wheel 121 having a first end provided with a stop disk 1211 and a second end provided with a connecting recess 1212, a positioning block 122 mounted on the stop disk 1211 of the driving wheel 121 and inserted into the receiving hole 1322 of the first side bracket 132 of the frame unit 13, a drive motor 123 mounted in the connecting recess 1212 of the driving wheel 121, and a conducting wire 124 extending through the driving wheel 121 and the positioning block 122 and having a first end connected with the drive motor 123 and a second end provided with a connector 1241 which is inserted into the connecting hole 1323 of the first side bracket 132 of the frame unit 13. The positioning block 122 of the transmission unit 12 has a square shape, and the receiving hole 1322 of the first side bracket 132 of the frame unit 13 also has a square shape. The drive motor 123 of the transmission unit 12 is selected from a direct-current motor having a direct-current voltage under 12V. Preferably, the optimum direct-current voltage of the drive motor 123 is about 4.5V. The conducting wire 124 of the transmission unit 12 is partially received and hidden in the first side bracket 132 of the frame unit 13 as shown in FIG. 7.

In the preferred embodiment of the present invention, the signal receiver 14 includes a hollow housing 141, an electric cord 142 having a first end connected with the housing 141 and a second end provided with a connecting terminal 143 which is coupled to and electrically connected with the connector 1241 of the conducting wire 124 of the transmission unit 12, a receiving module 144 mounted in the housing 141 and coupled to and electrically connected with the electric cord 142 to receive a signal transmitted by the controller 15, and a power supply module 145 mounted in the housing 141 to provide an electric power required by the signal receiver 14 and the transmission unit 12.

In the preferred embodiment of the present invention, the drive motor 123 of the transmission unit 12 is provided with a rotation disk 1231 mounted in the cavity 1111 of the drive shaft 111 of the winding unit 11. The rotation disk 1231 of the drive motor 123 has a periphery provided with a plurality of positioning slits 1232, and the cavity 1111 of the drive shaft 111 of the winding unit 11 has a periphery provided with a plurality of positioning ribs 1113 positioned in the positioning slits 1232 of the rotation disk 1231 of the drive motor 123. Thus, when the drive motor 123 is operated, the drive motor 123 drives and rotates the rotation disk 1231 which drives and rotates the drive shaft 111 of the winding unit 11.

In the preferred embodiment of the present invention, each of the two holding pieces 232 of each of the holding units 23 of the shading device 2 has a first end provided with a mounting portion 2321 and a second end provided with a holding piece 2324. The mounting portion 2321 of each of the two holding pieces 232 has a side provided with a mounting hole 2322 mounted on the rod 231 and has a front face provided with a screw bore 2323 connected to the mounting hole 2322. The screw bore 2323 of each of the two holding pieces 232 has a stepped shape. The holding piece 2324 of each of the two holding pieces 232 extends transversely and abuts the roll cloth member 112 of the winding unit 11 when the roll cloth member 112 hangs down. Each of the two fasteners 233 is a screw which is screwed into the screw bore 2323 of each of the two holding pieces 232 and presses the rod 231.

Figure 6:
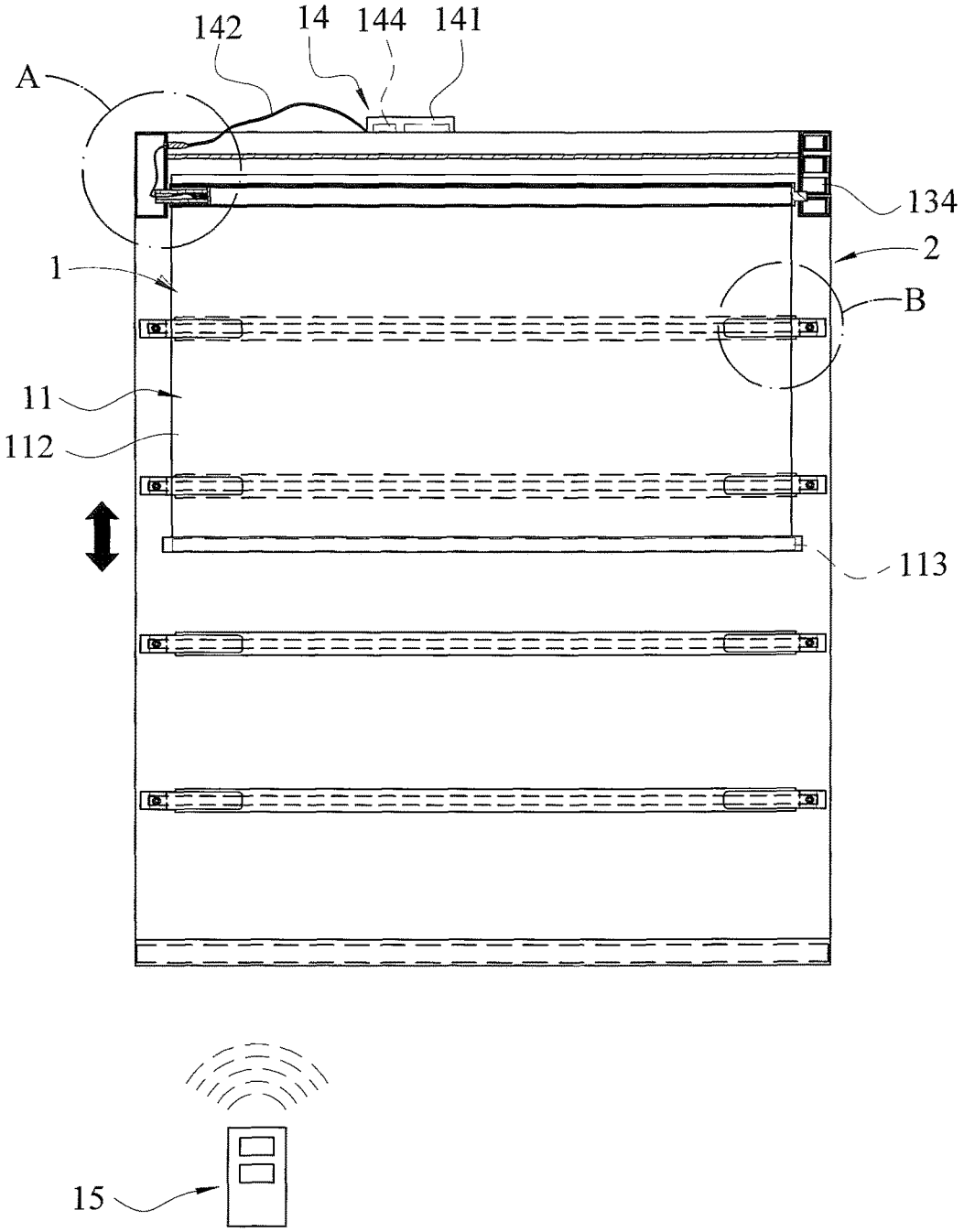
FIG. 6 is a schematic front operational view of the cordless motorized roller shade as shown in FIG. 1.
Figure 8:
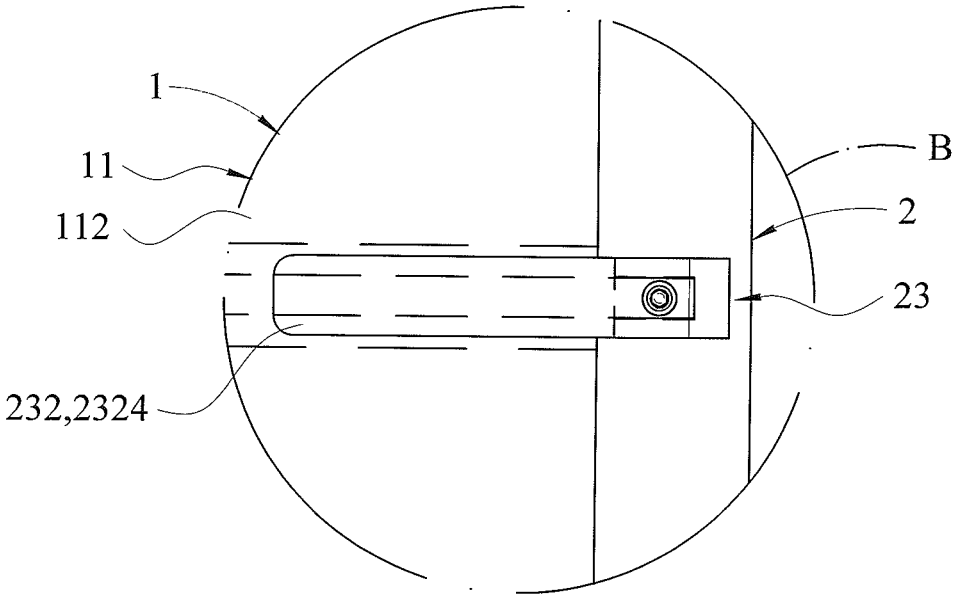
FIG. 8 is a locally enlarged view of the cordless motorized roller shade taken along mark "B" as shown in FIG. 6.
Figure 9:
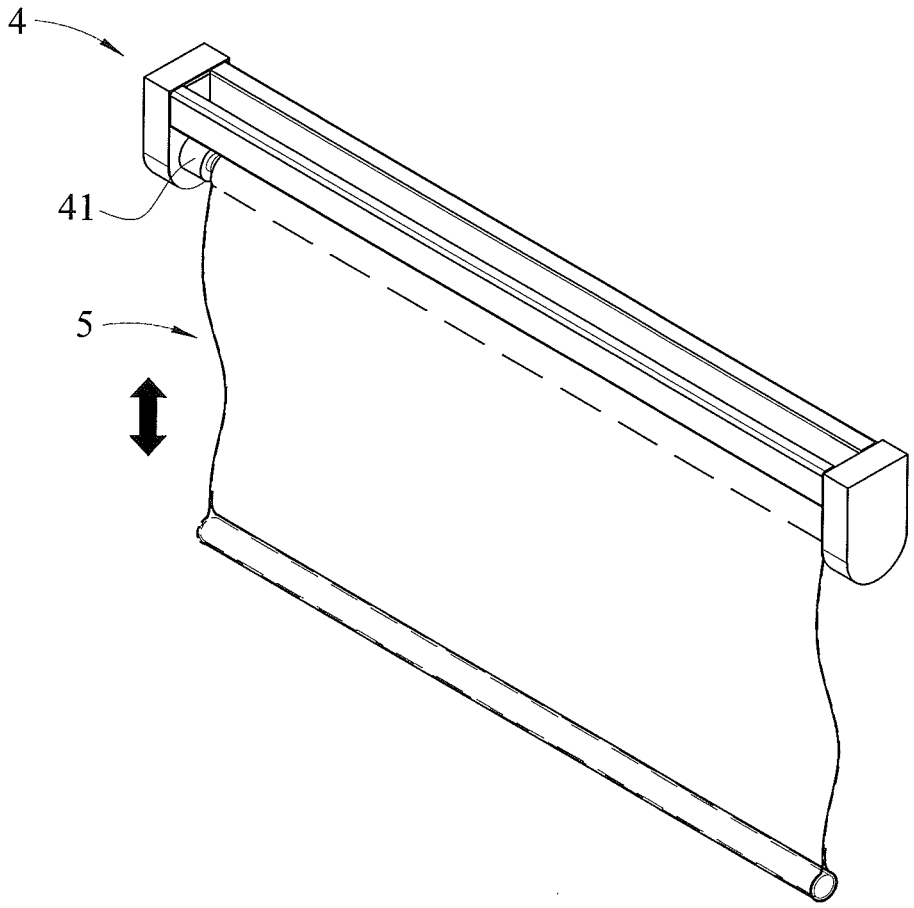
FIG. 9 PRIOR ART
FIG. 9 is a perspective view of a conventional roller shade in accordance with the prior art.

In operation, referring to FIGS. 6-8 with reference to FIGS. 1-5, the driving wheel 121 is received in the cavity 1111 of the drive shaft 111, and the stop disk 1211 of the driving wheel 121 abuts the first end of the drive shaft 111. The positioning ribs 1113 of the drive shaft 111 are positioned in the positioning slits 1232 of the rotation disk 1231 so that the drive shaft 111 is rotated in concert with the rotation disk 1231. Thus, when the drive motor 123 of the transmission unit 12 is operated, the rotation disk 1231 is rotated by the drive motor 123 to drive and rotate the drive shaft 111 of the winding unit 11.

When a button of the controller 15 is pressed, the controller 15 transmits a signal to the receiving module 144 of the signal receiver 14 to control operation of the transmission unit 12. At this time, the connecting terminal 143 of the electric cord 142 of the signal receiver 14 is coupled to and electrically connected with the connector 1241 of the conducting wire 124 of the transmission unit 12 as shown in FIG. 7, so that the signal receiver 14 is electrically connected with the transmission unit 12 to control operation of the drive motor 123 of the transmission unit 12 so as to drive and rotate the drive shaft 111 of the winding unit 11.

Thus, when the drive shaft 111 of the winding unit 11 is rotated, the roll cloth member 112 is driven by the drive shaft 111 to move upward or downward as shown in FIG. 6. In such a manner, when the roll cloth member 112 of the winding unit 11 is moved downward to hang down, the roll cloth member 112 is located at any position so that the roll cloth member 112 is disposed at a half extending state or a fully extending state. At this time, the first weight bar 113 of the winding unit 11 provides a downward force (by its gravity) to the roll cloth member 112, so that the downward gravity of the roll cloth member 112 is concentrated at a center position. In addition, the holding piece 2324 of each of the two holding pieces 232 of each of the holding units 23 of the shading device 2 hold the two sides of the roll cloth member 112 as shown in FIG. 8, so that the roll cloth member 112 is kept at a straight state when hanging down.

On the contrary, when the roll cloth member 112 of the winding unit 11 is moved and folded upward by operation of the transmission unit 12, the rotary return wheel module 134 aids the upward movement of the roll cloth member 112 to reduce consumption of the electric power of the drive motor 123 of the transmission unit 12 during operation so that the roll cloth member 112 of the winding unit 11 is folded upward in an energy-saving manner.

Accordingly, the roll cloth member 112 is kept at a straight state smoothly when hanging down by provision of the first weight bar 113 and each of the holding units 23 so as to enhance the outer appearance of the cordless motorized roller shade. In addition, when the roll cloth member 112 is moved upward, the rotary return wheel module 134 aids the upward movement of the roll cloth member 112 to reduce consumption of the electric power of the drive motor 123 during operation so that the roll cloth member 112 is folded upward in an energy-saving manner.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A cordless motorized roller shade comprising:

a motorized operation device, a shading device and a combination module;

wherein:

the motorized operation device includes a winding unit, a transmission unit, a frame unit, a signal receiver and a controller;

the winding unit includes:

a drive shaft;

a roll cloth member having an upper end affixed to the drive shaft and a lower end provided with a first tubular portion; and a first weight bar mounted in the first tubular portion of the roll cloth member;

the drive shaft of the winding unit has a first end provided with a cavity and a second end provided with a pivot portion;

the transmission unit is mounted in the cavity of the drive shaft of the winding unit to drive and rotate the drive shaft of the winding unit to wind or unwind the roll cloth member of the winding unit;

the frame unit supports the winding unit and the transmission unit;

the frame unit includes:

a fixed track;

a first side bracket mounted on a first end of the fixed track for mounting the transmission unit;

a second side bracket mounted on a second end of the fixed track for mounting the pivot portion of the drive shaft of the winding unit; and a rotary return wheel module mounted in the second side bracket and pivotally connected with the pivot portion of the drive shaft of the winding unit;

the signal receiver is coupled to and electrically connected with the transmission unit;

the controller matches the signal receiver and transmits a signal to the signal receiver to control operation of the transmission unit;

the shading device includes:

a shade cloth member having an upper end secured to the fixed track of the frame unit of the motorized operation device and a lower end provided with a second tubular portion;

a second weight bar mounted in the second tubular portion of the shade cloth member; and a plurality of holding units mounted on the shade cloth member;

the shade cloth member of the shading device has a front face provided with a plurality of mounting sleeves;

each of the plurality of holding units of the shading device includes:

a rod mounted in each of the plurality of mounting sleeves of the shade cloth member;

two holding pieces mounted on two ends of the rod; and two fasteners respectively mounted on the two holding pieces and pressing the rod so that the two holding pieces are affixed to the rod;

the combination module is mounted between the motorized operation device and the shading device and includes:

a first connecting member mounted on the fixed track of the frame unit of the motorized operation device; and a second connecting member mounted on the shade cloth member of the shading device;

the second connecting member is removably connected with the first connecting member so that the shading device and the motorized operation device are connected detachably;

the fixed track of the frame unit of the motorized operation device is provided with a receiving channel for mounting the first side bracket and the second side bracket;

the first side bracket is provided with at least one locking end inserted into the receiving channel of the fixed track;

the first side bracket is further provided with a receiving hole and a connecting hole;

the transmission unit is received in the receiving hole of the first side bracket;

the second side bracket is provided with at least one locking end inserted into the receiving channel of the fixed track;

the second side bracket is provided with a receiving aperture;

the pivot portion of the drive shaft of the winding unit is received in the receiving aperture of the second side bracket; and the transmission unit includes:

a driving wheel having a first end provided with a stop disk and a second end provided with a connecting recess;

a positioning block mounted on the stop disk of the driving wheel and inserted into the receiving hole of the first side bracket of the frame unit;

a drive motor mounted in the connecting recess of the driving wheel; and a conducting wire extending through the driving wheel and the positioning block and having a first end connected with the drive motor and a second end provided with a connector which is inserted into the connecting hole of the first side bracket of the frame unit.

2. The cordless motorized roller shade of claim 1, wherein the signal receiver includes:

a housing;

an electric cord having a first end connected with the housing and a second end provided with a connecting terminal which is coupled to and electrically connected with the connector of the conducting wire of the transmission unit;

a receiving module mounted in the housing and coupled to and electrically connected with the electric cord to receive a signal transmitted by the controller; and a power supply module mounted in the housing to provide an electric power required by the signal receiver and the transmission unit.

3. The cordless motorized roller shade of claim 1, wherein the drive motor of the transmission unit is selected from a direct-current motor having a direct-current voltage under 12V, and an optimum direct-current voltage of the drive motor is about 4.5V.

4. The cordless motorized roller shade of claim 1, wherein:

the drive motor of the transmission unit is provided with a rotation disk mounted in the cavity of the drive shaft of the winding unit;

the rotation disk of the drive motor has a periphery provided with a plurality of positioning slits; and the cavity of the drive shaft of the winding unit has a periphery provided with a plurality of positioning ribs positioned in the positioning slits of the rotation disk of the drive motor.

5. The cordless motorized roller shade of claim 1, wherein:

each of the two holding pieces of each of the holding units of the shading device has a first end provided with a mounting portion and a second end provided with a holding piece;

the mounting portion of each of the two holding pieces has a side provided with a mounting hole mounted on the rod and has a front face provided with a screw bore connected to the mounting hole;

the holding piece of each of the two holding pieces abuts the roll cloth member of the winding unit when the roll cloth member hangs down; and each of the two fasteners is a screw which is screwed into the screw bore of each of the two holding pieces and presses the rod.

* * * * *